US005681431A

United States Patent [19]

Steiner

[11] Patent Number: 5,681,431

[45] Date of Patent: Oct. 28, 1997

[54] PRESS SECTION FOR A PAPER MACHINE

[75] Inventor: Karl Steiner, Herbrechtingen, Germany

[73] Assignee: J.M. Voith GmbH, Germany

[21] Appl. No.: 342,616

[22] Filed: Nov. 21, 1994

[30] Foreign Application Priority Data

Nov. 24, 1993 [DE] Germany ..... 43 40 041.8

[51] Int. Cl.[6] ..... D21F 3/02

[52] U.S. Cl. ..... 162/360.2; 162/358.3; 162/360.3; 162/306

[58] Field of Search ..... 162/358.3, 360.2, 162/360.3, 306, 307

[56] References Cited

U.S. PATENT DOCUMENTS

| | | | |
|---|---|---|---|
| 4,192,711 | 3/1980 | Tapio et al. | 162/305 |
| 4,285,766 | 8/1981 | Kankaanpaa | 162/360.3 |
| 4,406,739 | 9/1983 | Kankaanpaa | 162/306 |
| 4,483,745 | 11/1984 | Wicks et al. | 162/205 |
| 4,657,634 | 4/1987 | Autio | 162/272 |
| 4,976,820 | 12/1990 | Laapotti | 162/360.3 |
| 5,037,509 | 8/1991 | Wedel | 162/193 |
| 5,120,399 | 6/1992 | Filzen | 162/205 |
| 5,178,732 | 1/1993 | Steiner et al. | 162/358.3 |

FOREIGN PATENT DOCUMENTS

| | | | |
|---|---|---|---|
| 9206340 | 9/1992 | Germany | 162/358.3 |
| 4321404 | 11/1993 | Germany | 162/360.3 |

*Primary Examiner*—Karen M. Hastings
*Attorney, Agent, or Firm*—Baker & Daniels

[57] ABSTRACT

The invention concerns a press section for a paper machine with at least two presses which are successively passed by a web to be dewatered, the web alternately making contact with a press felt and a closed shell surface of a press roll. The first press is fashioned as a single-felted shoe press and configured such that the one web side will make contact with a first smooth press element. The second press is fashioned single-felted as well and configured such that the other web side makes contact with a second, smooth press element. A web transport system is provided between each two adjacent presses. The invention is characterized in that the web transport system features a guide roll with smooth shell surface serving to pick up the web, at least during normal operation, directly from the smooth press element of the first press.

10 Claims, 3 Drawing Sheets

PRESS SECTION FOR A PAPER MACHINE

BACKGROUND OF THE INVENTION

The invention relates to a press section for a paper machine having at least two presses which are successively passed by a web to be dewatered, the web alternately making contact with a press felt and a closed shell surface of a press roll. Reference is made to U.S. Pat. Nos. 5,120,399 and 4,483,745.

Paper grades of low basis weight require employment of single-felt presses, that is, presses whose gap is being passed by only one felt. The reason therefor is that the paper web picks up water from the felts directly at the exit, when passing the press gap. Among experts, this phenomenon is known as "remoistening." Remoistening is highly undesirable, since it limits the efficiency of the press. With single-felt presses, appropriately high press pressures allow achieving a relatively dry, firm sheet which, due to its relatively high dry content, possesses sufficient strength for nonproblematic transfer to a follow-on processing station, for instance a second press. Such single-felt presses usually are shoe presses.

In the press gap of such single-felt press the paper web makes on its one side contact with the felt, on its other side with the smooth shell surface of the backing roll of such a press. As a result, the felt-contacted side of the paper web becomes relatively rough, its other side relatively smooth. Hence, the paper web has two sides of different quality. Such duality is undesirable: as the paper is imprinted, the quality of printing differs on the two sides.

Not only is the surface roughness unequal on the two sides of the paper web, but also the so-called picking tendency, that is, the tendency to release fibers, which on the felt side is greater than on the other side of the paper web. Increased picking tendency equates in the finished paper with a high dusting tendency, which is undesirable as well.

It is known to have a single-felted shoe press followed by a single-felted regular press. This is a press featuring two press rolls with smooth shell surfaces, additionally a felt passing through the press gap, along with the paper web. The arrangement is such that the web side, which in the shoe press, was in contact with the felt will now, in the second press, make contact with the smooth shell surface of the one press roll, whereas the other paper web side, which previously made contact with the smooth shell surface, comes now in contact with the felt.

The nip force of such second roll press is typically much lower than that of the prior shoe press. The second roll press does not remove any appreciable amounts of water from the paper web, so that its dry content remains essentially unchanged or changes only slightly.

Using such second roll press reduces to a certain extent the duality conferred to the paper web in the shoe press. Nonetheless, duality still is present.

The problem underlying the invention is to provide a press section of the type described above with a design such that the duality of the paper web will be reduced to a degree greater still than is the case with prior press sections.

SUMMARY OF THE INVENTION

The disadvantages of the prior art are overcome by providing a paper making machine of the general type described above wherein the web transport system between the first and second single-felted presses includes a guide roll with a smooth shell surface serving to pick off the web directly from the smooth press element of the first press. The guide roll is preferably moveable so as to form with the smooth press element a contact gap that permits adjustment of the press force at about a zero level.

BRIEF DESCRIPTION OF THE DRAWINGS

The invention will be more fully explained with the aid of the drawings wherein.

DETAILED DESCRIPTION OF THE INVENTION

Figure 1:
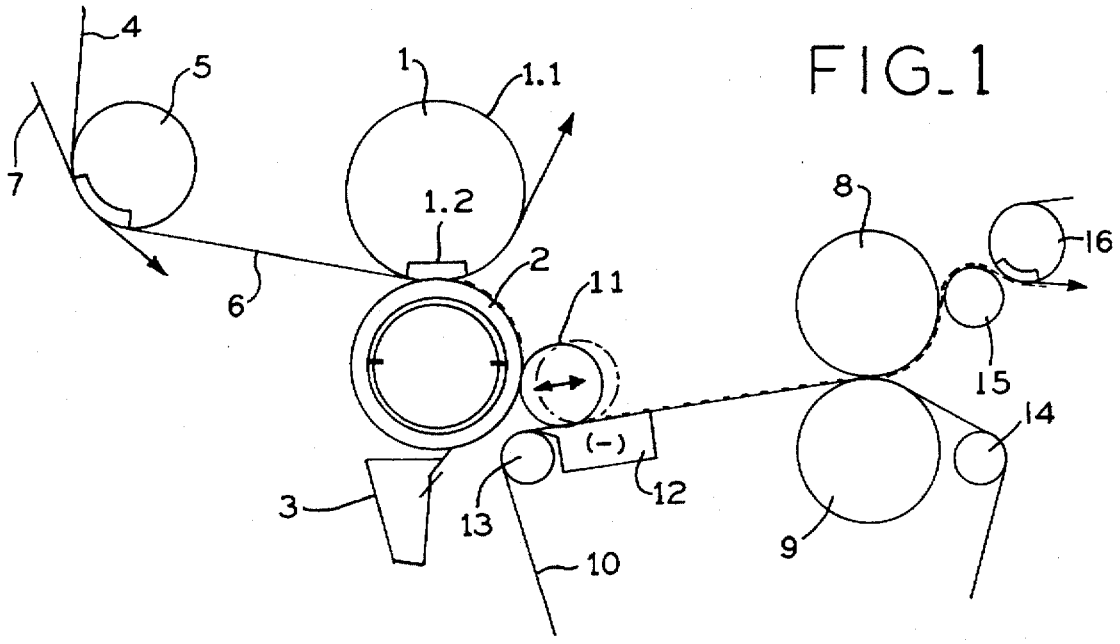
FIGS. 1, 1A and 2 through 5 are schematic views of six different embodiments of the present invention. Same or corresponding components are referenced identically in the individual figures.

The press section according to FIG. 1 features a shoe press with a shoe unit 1 and a backing roll 2. The shoe unit 1 is comprised of a revolving belt 1.1 impermeable to water and of the shoe 1.2. Coordinated with the backing roll 2 is a scraper system 3. A felt 4, to begin with, wraps around a pick-up suction roll 5 for picking the paper web 6 (shown dashed) off the wire 7 of the paper machine.

The press section includes a follow-on, second roll press with press rolls 8 and 9, both having smooth, that is, closed shell surfaces. A felt 10 passes through the gap of the second roll press.

An essential element is a guide roll 11 with a smooth shell surface. The shell surface of the guide roll 11 bears both on the shell of backing roll 2 and on the felt 10, the latter wrapping around a slide shoe 12 in the area of the guide roll 11. Slide shoe 12 may feature suction.

The press section incorporates further elements, of which guide rolls 13 through 16 are illustrated.

To begin with, the paper web 6 is picked up from the wire 7 of the press section, which otherwise is not illustrated, by means of the first press felt 4. The pick-up felt 4 makes contact with the top side of the web when picking it up from the wire section and then transfers the web to the surface of the first smooth press element of the first press so that the first smooth press element makes contact with the underside of the web. It is also possible to heat the first smooth press element of the first press to thereby reduce the adhesion of the web to the smooth press element of the first press. Thus, clinging to the underside of press felt 4, the paper web 6 is then passed to the gap of the shoe press and through it, wraps around backing roll 2 by approximately one-fourth quadrant, is then picked up by the guide roll 11, passed to the second press felt 10 and transferred to it; thereafter it is passed from the second press felt 10, while borne by it, to the gap of the second press roll 8, 9 and through it, proceeding to further processing.

Figure 1A:
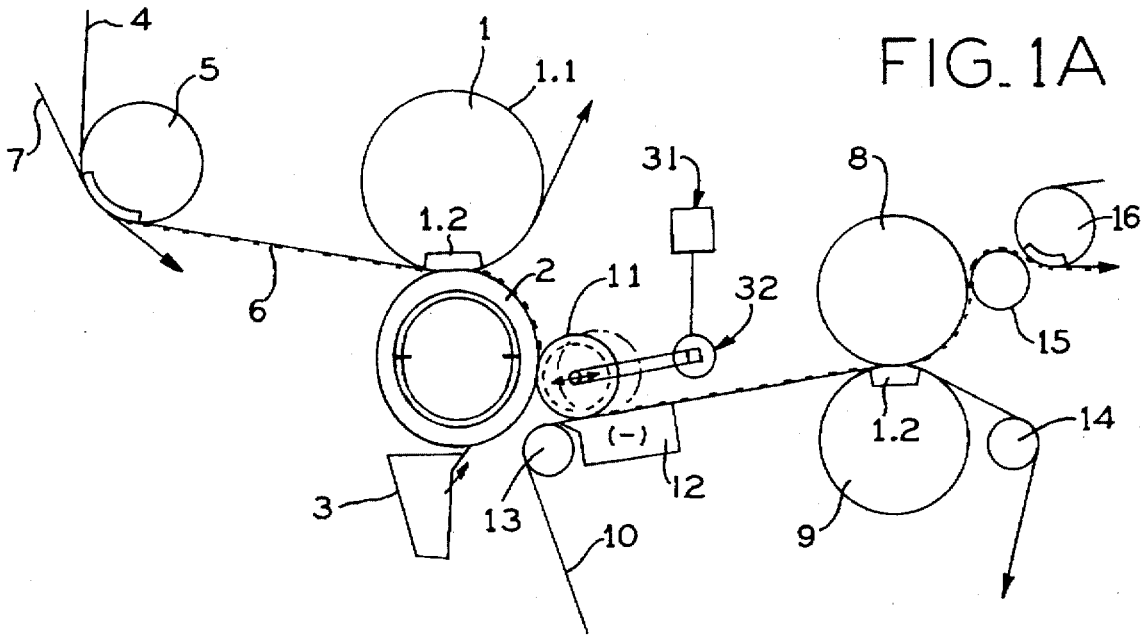

It is important that guide roll 11 can be advanced onto the backing roll 2 and retracted from it as indicated by with the double arrow. Possible also is moving the guide roll 11 toward and away from the second press felt 10. A control system may be used to maintain contact between the guide roll and the smooth press element of the first press during normal operations and, when the web is being threaded, maintain the guide roll in a position which provides a small space between the guide roll and the smooth press element of the first press. FIG. 1*a* illustrates such a control system which comprises a controller 31 and motor 32 to move the guide roll. It is also possible to use a guide roll having a soft shell as shown in FIG. 1*a*.

It is important, moreover, that paper web 6 will in the shoe press make on its one side contact with the felt 4, while in the follow-on press it will make contact with the felt 10 on its other side. The second press is not limited to the structure of FIG. 1, and, for example, may be fashioned as a shoe press as shown in FIG. 1*a*.

Figure 2:
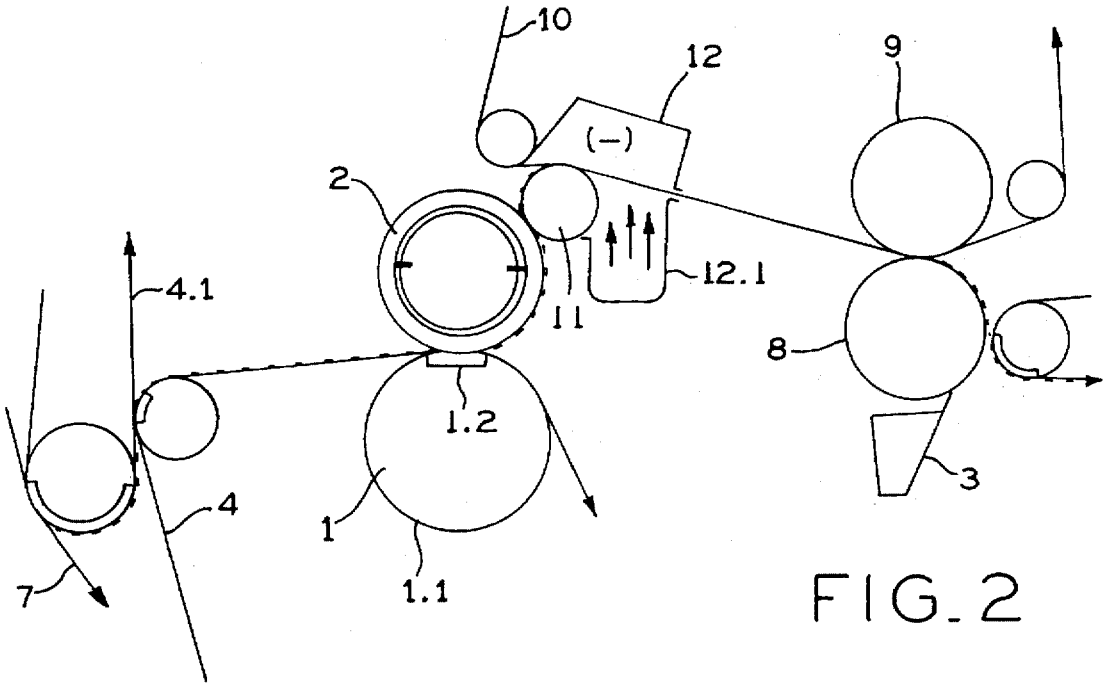

The press section pursuant to FIG. 2 differs from that relative to FIG. 1 in the following respects:

A pick-up felt 4.1 is interposed between wire 7 and the first press felt 4. The shoe press illustrated here, as compared to the one shown in FIG. 1, is inverted, i.e., the shoe unit 1 is situated on the underside. Consequently, guide roll 11 is located in the upper area of the shoe press. Provided is not only a suction box 12, but also a steam blowing box 12.1. Here, too, guide roll 11 again may be installed allowing advance in different directions and the suction box may have a sliding surface of concave curvature in which the guide roll is received. For example, it may allow also radial pivoting around the backing roll 2, which, incidentally, may be the case also with the press sections according to the remaining figures.

Figure 3:
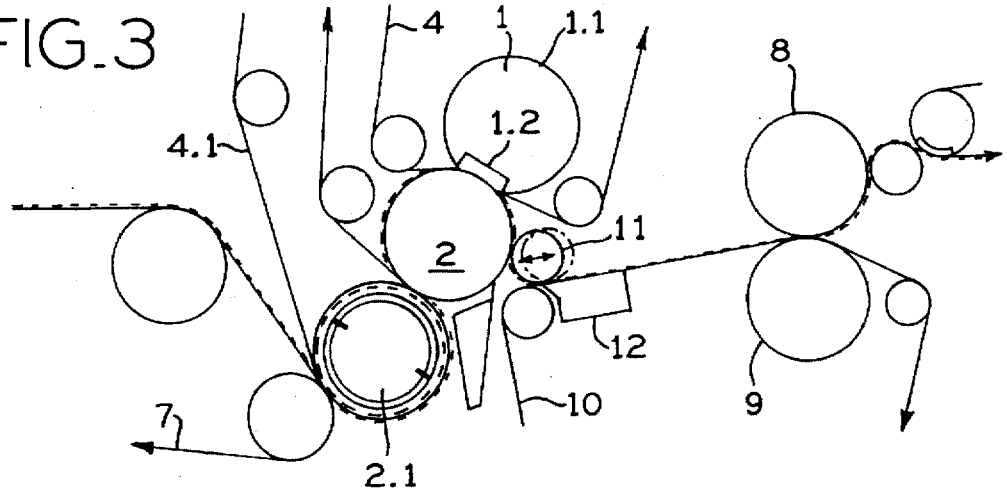

The press section according to FIG. 3 presents a peculiarity insofar as it features a plurality of press gaps. The press again is comprised of a shoe unit 1 with press belt 1.1 and shoe 1.2, additionally a backing roll 2 and a further roll 2.1. A pick-up felt 4.1 wraps around roll 2.1.

Figure 4:
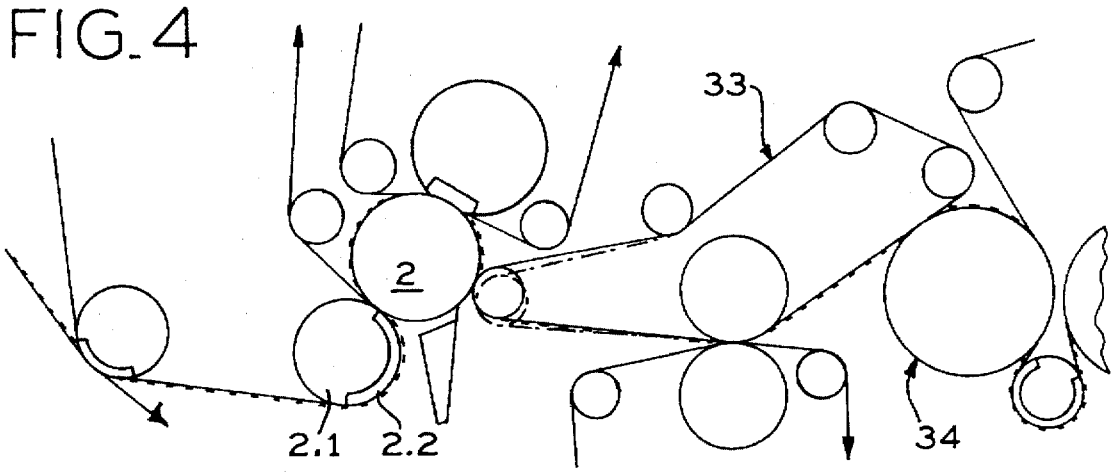
Figure 5:
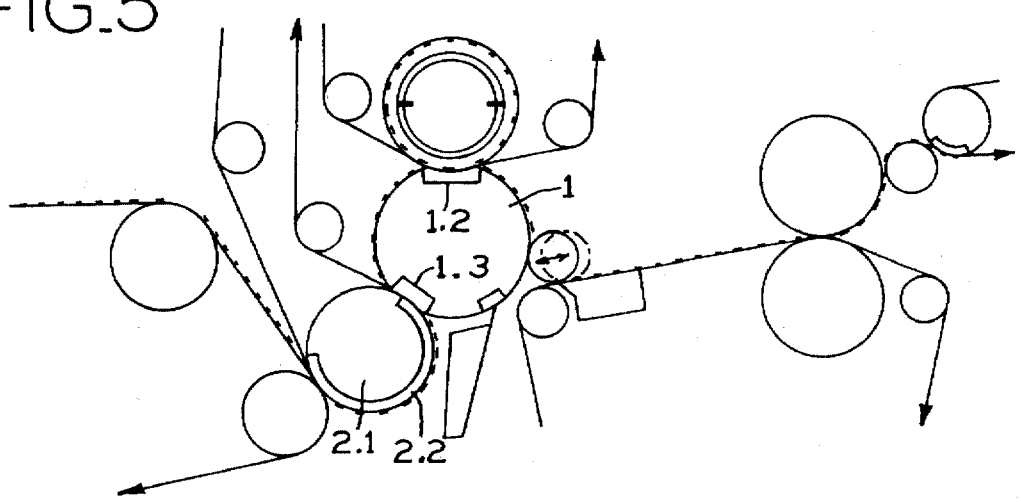

The remaining press sections according to FIGS. 4 and 5 also are configured similarly to the one in FIG. 3; namely, each features three elements: the shoe unit 1 and two press rolls 2 and 2.1. In the embodiment according to FIG. 4, roll 2.1 is provided with a suction zone 2.2, the same as roll 2.1 in FIG. 5. A pick-up felt guide roll which forms an additional pre-press gap with the with the first smooth press element of the first press may also be used. Also shown in FIG. 4 is a smooth, non-absorbent belt 33 which passes through the second press and wraps the movable guide roll thereby being brought into contact with the smooth press element of the first press is shown in FIG. 4. After passing through the second press the smooth, non-absorbent belt 33 may transfer the web to a drying section. The drying section can comprise a first drying cylinder 34 as shown in FIG. 4. The smooth, non-absorbent belt 33 may directly transfer the web to the surface of the first drying cylinder 34. The shoe unit 1 in FIG. 5 has two press shoes 1.2 and 1.3.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press section for a paper machine for dewatering a web passing therethrough, said press section comprising:

a first press fashioned as a single-felted shoe press and including a first smooth press element, said first press configured such that one side of the web makes contact with said first press element;

a second press fashioned as a single felted press and including a second smooth press element, said second press configured such that the other side of the web makes contact with said second press element; and a web transport system provided between said first and second presses, said web transport system including a guide roll having a smooth surface positioned to pick up the web directly from said first smooth press element, said guide roll movable toward and away from said first smooth press element and forming with the first smooth press element a contact gap, thereby allowing adjustment of a press force near or equal to zero, said guide roll constantly in contact with the felt of said second press and transferring said web to said felt of said second press wherein the felt of said second press runs in the area of the point of contact with said guide roll across a stationary suction box having a planar or concave sliding surface opposing said guide roll.

2. The press section according to claim 1, wherein on the side of said second press felt opposite said suction box there is provided a steam blowing device.

3. The press section according to claim 1, comprising a control system which in normal operation maintains said guide roll in contact with said smooth press element of the first press, whereas in web threading it maintains the guide roll slightly spaced from said smooth press element of the first press.

4. The press section according to claim 1, wherein said second press has a press force which is only a fraction of a press force of said first press.

5. The press section according to claim 4, wherein said second press is fashioned as a shoe press.

6. The press section according claim 1 including a pick-up felt making contact with a top side of the web that picks the web up from a preceding wire section and transfers it to the surface-of said first smooth press element of the first press, so that said first smooth press element makes contact with an underside of the web.

7. The press section according to claim 6, including a pick-up felt guide roll forming with said first smooth press element of the first press an additional pre-press gap.

8. The press section according to claim 1, wherein said first smooth press element of the first press is heatable so as to reduce the adhesion of the web to said first smooth press element.

9. The press section according to claim 1, wherein said guide roll has a soft shell.

10. A press section for a paper machine for dewatering a web passing therethrouh, said press section comprising;

a first press fashioned as a single-felled shoe press and including a first smooth press element, said first press configured such that one side of the web makes contact with said first press element;

a second press fashioned as a single felted press and including a second smooth press element, said second press configured such that the other side of the web makes contact with said second press element; and a web transport system provided between said first and second presses, said web transport system including a guide roll having a smooth surface positioned to pick up the web directly from said first smooth press element, said guide roll constantly in contact with the felt of said second press and transferring said web to said felt of said second press wherein the felt of said second press runs in the area of the point of contact with said guide roll across a suction box opposing said guide roll , wherein said suction box has a sliding surface of concave curvature in which said guide roll is received.

* * * * *